US011642698B2

(12) United States Patent
Yoo

(10) Patent No.: US 11,642,698 B2
(45) **Date of Patent: *May 9, 2023**

(54) VIBRATION DEVICE USING SOUND AND SYSTEM COMPRISING THE SAME

(71) Applicant: BEATSNINE INC., Seongnam-si (KR)

(72) Inventor: Ji Seung Yoo, Seoul (KR)

(73) Assignee: BEATSNINE INC., Seongnam-si (KR)

( * ) Notice: Subject to any disclaimer, the term of this patent is extended or adjusted under 35 U.S.C. 154(b) by 359 days.

This patent is subject to a terminal disclaimer.

(21) Appl. No.: 16/651,336

(22) PCT Filed: Oct. 7, 2019

(86) PCT No.: PCT/KR2019/013119

§ 371 (c)(1),
(2) Date: Mar. 26, 2020

(87) PCT Pub. No.: WO2020/241980

PCT Pub. Date: Dec. 3, 2020

(65) Prior Publication Data

US 2021/0402436 A1 Dec. 30, 2021

(30) Foreign Application Priority Data

May 24, 2019 (KR) ..... 10-2019-0061010

(51) Int. Cl.

| | |
|---|---|
| ***B06B 1/16*** | (2006.01) |
| ***H04R 1/02*** | (2006.01) |
| ***H04R 5/02*** | (2006.01) |

(52) U.S. Cl.

CPC ..... *B06B 1/161* (2013.01); *H04R 1/028* (2013.01); *H04R 5/023* (2013.01); *H04R 2400/03* (2013.01)

(58) Field of Classification Search

CPC ..... B06B 1/161; H04R 1/028; H04R 1/02; H04R 1/025; H04R 1/026; H04R 1/2807;
(Continued)

(56) References Cited

U.S. PATENT DOCUMENTS 5,314,403 A 5/1994 Shaw
9,474,683 B1 * 10/2016 Mortimer ..... A61H 23/0263
(Continued)

FOREIGN PATENT DOCUMENTS

CN 1154236 A 7/1997
JP 2002-149312 A 5/2002
(Continued)

*Primary Examiner* — Ahmad F. Matar
*Assistant Examiner* — Sabrina Diaz
(74) *Attorney, Agent, or Firm* — Park, Kim & Suh, LLC

(57) ABSTRACT

Provided is a vibration device using sound and a system comprising the same. More particularly, the present invention relates to a vibration device for generating vibration using sound such that the beat of the sound can be felt, which is convenient to carry or transfer due to a lightweight and compact size thereof, is capable of generating vibration matching the beat of sound to which a user is currently listening, is furthermore capable of generating vibrations of various feelings matching the beat of sound according to user settings, thereby greatly enhancing effects that the user may feel, and is very inexpensive to manufacture, and a system comprising the vibration device.

11 Claims, 7 Drawing Sheets

(58) Field of Classification Search
CPC ..... H04R 1/2811; H04R 5/023; H04R 5/02; H04R 2400/03; H04R 2460/13
USPC ..... 181/207; 381/87, 333, 334, 151, 386, 381/388, 395
See application file for complete search history.

(56) References Cited

U.S. PATENT DOCUMENTS

| | | | | |
|---|---|---|---|---|
| 2009/0136075 | A1 | 5/2009 | Meyer | |
| 2013/0107216 | A1* | 5/2013 | Haight | A63F 13/28 352/1 |

FOREIGN PATENT DOCUMENTS

| | | | |
|---|---|---|---|
| KR | 10-2006-0109172 | A | 10/2006 |
| KR | 10-2014-0136137 | A | 11/2014 |
| KR | 10-1947955 | B1 | 2/2019 |
| WO | 2017142333 | A1 | 8/2017 |

* cited by examiner

VIBRATION DEVICE USING SOUND AND SYSTEM COMPRISING THE SAME

CROSS-REFERENCE TO RELATED APPLICATIONS

This application is the National Stage filing under 35 U.S.C. 371 of International Application No. PCT/KR2019/013119, filed on Oct. 7, 2019, which claims the benefit of Korean Patent Application No. 10-2019-0061010, filed on May 24, 2019, the contents of which are all hereby incorporated by reference herein in their entirety.

TECHNICAL FIELD

The present invention relates to a vibration device using sound and system comprising the same. More particularly, the present invention relates to a vibration device for generating vibration using sound such that the beat of the sound can be felt, which is convenient to carry or transfer due to a lightweight and compact size thereof, is capable of generating vibration matching the beat of sound to which a user is currently listening, is furthermore capable of generating vibrations of various feelings matching the beat of sound according to user settings, thereby greatly enhancing effects that the user may feel, and is very inexpensive to manufacture, and a system comprising the vibration device.

BACKGROUND ART

There is a growing need for a device and method for providing an effect of circumstances synchronized with video or music through a sense of touch, i.e., a non-unpleasant physical stimulation, among the five senses of human being to facilitate immersion in the video or the music, so that the psychology of people today who want to have unique and diverse experiences different from those when the video or the music is evaluated depending mainly on a sense of vision or a sense of hearing may be reflected.

For example, when a movie is watched sitting on a chair of a theater, a large-scale event hall of an amusement park or a three-dimensional (3D) movie theater, or the like, a sound vibration chair equipped with a sound vibration device is generally used so that various circumstances in the movie can be indirectly experienced.

A representative example of such a sound vibration chair is a sound vibration chair equipped with a vibration device such as a transducer, which is a system in which the chair is synchronized with sound to be vibrated according to the sound of video, and includes expensive devices such as an transducer, an analog frequency filter, an amplifier, and the like and thus is expensive.

In addition, such a sound vibration chair is a device that generates vibration by simply dividing an analog sound signal into analog sound signals according to frequency bands by an analog frequency filter or the like and directly inputting the analog sound signals to a vibrator such as a transducer and thus responds passively to the strength of the analog sound signals. Therefore, a user cannot arbitrarily change or add vibration.

Accordingly, there is an urgent need for a vibration device for generating vibration using sound such that the beat of the sound can be felt, which is convenient to carry or transfer due to a lightweight and compact size thereof, is capable of providing various vibration effects according to the beat and rhythm of sound that a user actually feels to give excitement to the user, and is inexpensive to manufacture, and a sound a vibration system comprising the vibration device.

DETAILED DESCRIPTION OF THE INVENTION

Technical Problem

The present invention is directed to providing a vibration device for generating vibration using sound such that the beat of the sound can be felt, and a sound vibration system comprising the vibration device.

The present invention is also directed to providing a vibration device that is convenient to carry or transfer due to a lightweight and compact size thereof and is inexpensive to manufacture, and a sound vibration system comprising the vibration device.

The present invention is also directed to providing a vibration device for providing various vibration effects matching the beat and rhythm of sound that a user actually feels to enhance an effect of listening to music, and a sound vibration system comprising the vibration device.

Technical Solution

According to an aspect of the present invention, provided is a vibration module for a vibration device with a cushion, the vibration module comprising: a fixing part mounted and fixed on the cushion; a vibration transmission part connected to the fixing part to be in contact with the user's body so as to transmit vibration to a user; and a vibration part configured to generate vibration and apply the generated vibration to the vibration transmission part, wherein the vibration transmission part is disposed in an inner empty space of the fixing part, and the fixing part and the vibration transmission part are connected to each other via at least one elastic member.

According to another aspect of the present invention, provided is the vibration module, wherein the vibration transmission part comprises: a vibration plate to which the vibration part is connected; and at least one protruding pin on an upper surface of the vibration plate.

According to other aspect of the present invention, provided is the vibration module, wherein the fixing part has a circular ring shape, the vibrating plate has a circular shape corresponding to a shape of the inner empty space of the fixing part, and the distance between an inner wall of the fixing part and the vibration plate is 1 to 100 mm.

According to other aspect of the present invention, provided is the vibration module, wherein a plurality of elastic members are provided, wherein the plurality of elastic members are arranged at regular intervals in a space between the fixing part and the vibration plate.

According to other aspect of the present invention, provided is the vibration module, wherein an upper surface of the fixing part and an upper surface of the protruding pin are flush with each other.

According to other aspect of the present invention, provided is the vibration module, wherein a cross-sectional area of the protruding pin is 15 to 40% of an area of the upper surface of the vibration plate.

According to other aspect of the present invention, provided is the vibration module, wherein the vibration part comprises: a motor including a main body and a rotating rod; an eccentric weight connected to the rotating rod; and a coupling member for fixing the main body onto the vibration transmitting part.

According to other aspect of the present invention, provided is a vibration device comprising: a cushion; at least one vibration module, the at least one vibration module being mounted on the cushion; a controller configured to transmit a driving signal to the at least one vibration module; and a power supply configured to supply power to the at least one vibration module and the controller.

According to other aspect of the present invention, provided is the vibration system using sound, comprising: an application for a portable terminal, the application being installed in a portable terminal; and the vibration device of claim 8, the vibration device being configured to generate and transmit vibration according to a vibration control signal from the application for the portable terminal, wherein the application for the portable terminal generates the vibration control signal by processing a digital sound signal obtained by converting an analog sound signal received via a microphone of the portable terminal, a digital sound signal streamed over the Internet, or a digital sound signal from a sound source file stored in an internal storage of the portable terminal, and the vibration device receives the vibration control signal through the controller and transmits a driving signal for driving the at least one vibration module to the at least one vibration module according to the vibration control signal.

According to other aspect of the present invention, provided is the vibration system, wherein the application for the portable terminal generates the vibration control signal by performing fast Fourier transform on the digital sound signal.

Advantageous Effects

A vibration device according to the present invention exhibits an excellent effect of maximizing effects that a user feels because part thereof in contact with the human body is precisely designed.

In addition, the vibration device according to the present invention is convenient to carry or transfer due to a lightweight and compact size thereof and is inexpensive to manufacture.

MODE OF THE INVENTION

Hereinafter, exemplary embodiments of the present invention will be described in detail. The present invention is, however, not limited thereto and may be embodied in many different forms. Rather, the embodiments set forth herein are provided so that this disclosure may be thorough and complete and fully convey the scope of the invention to those of ordinary skill in the art. Throughout the specification, the same reference numbers represent the same elements.

Figure 1:
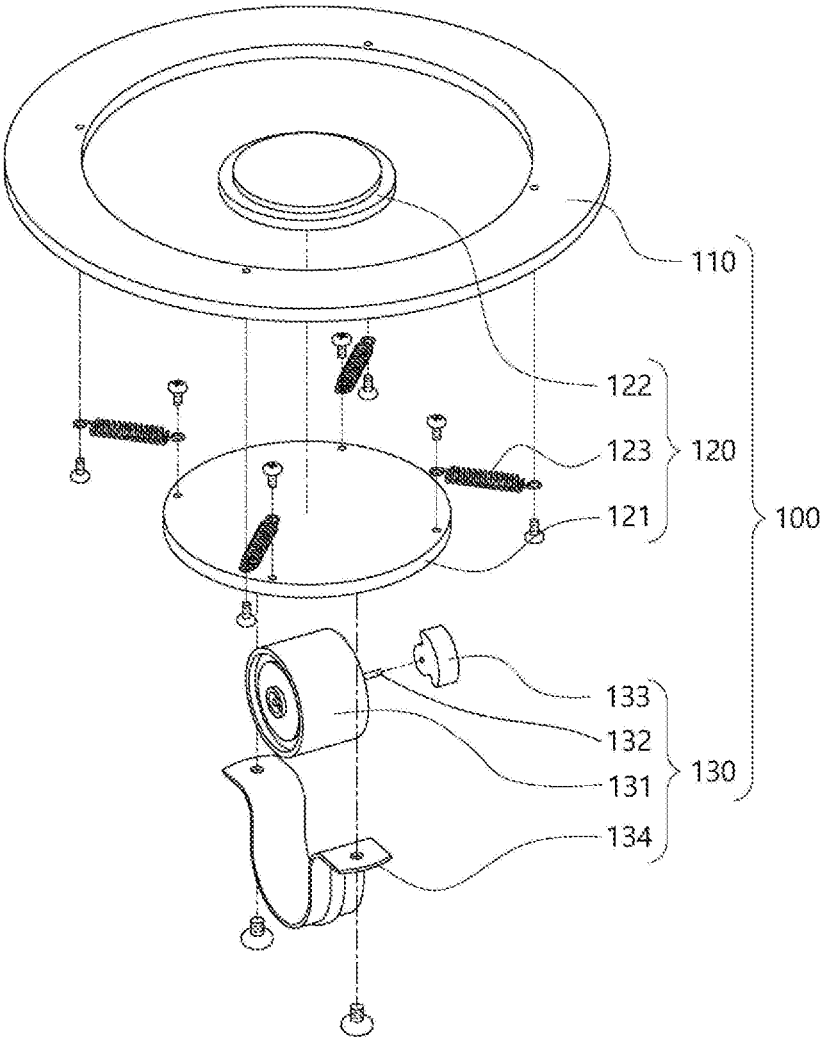
FIG. 1 is an exploded perspective view of a vibration module included in a vibration device according to the present invention.
Figure 2:
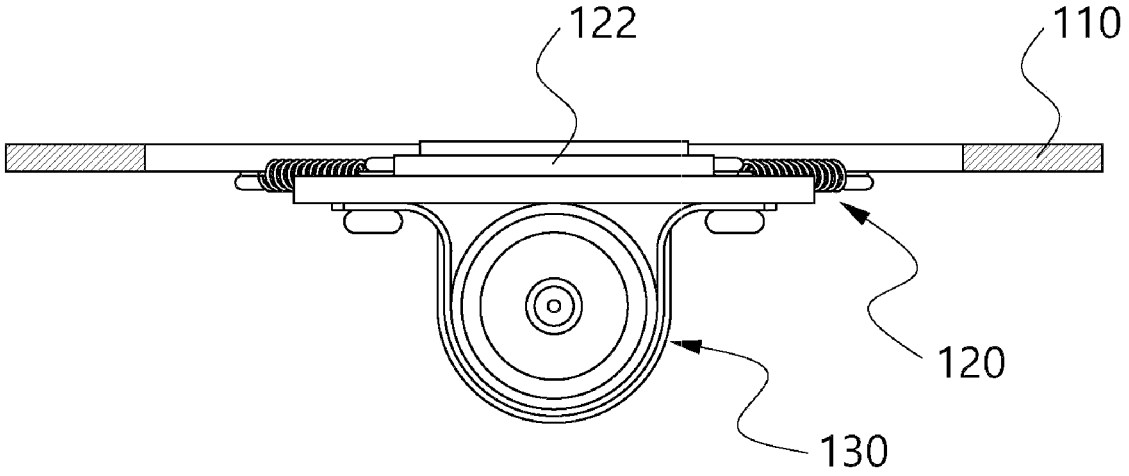
FIG. 2 is a schematic side view illustrating a configuration of a vibration module included in a vibration device according to the present invention.
Figure 3:
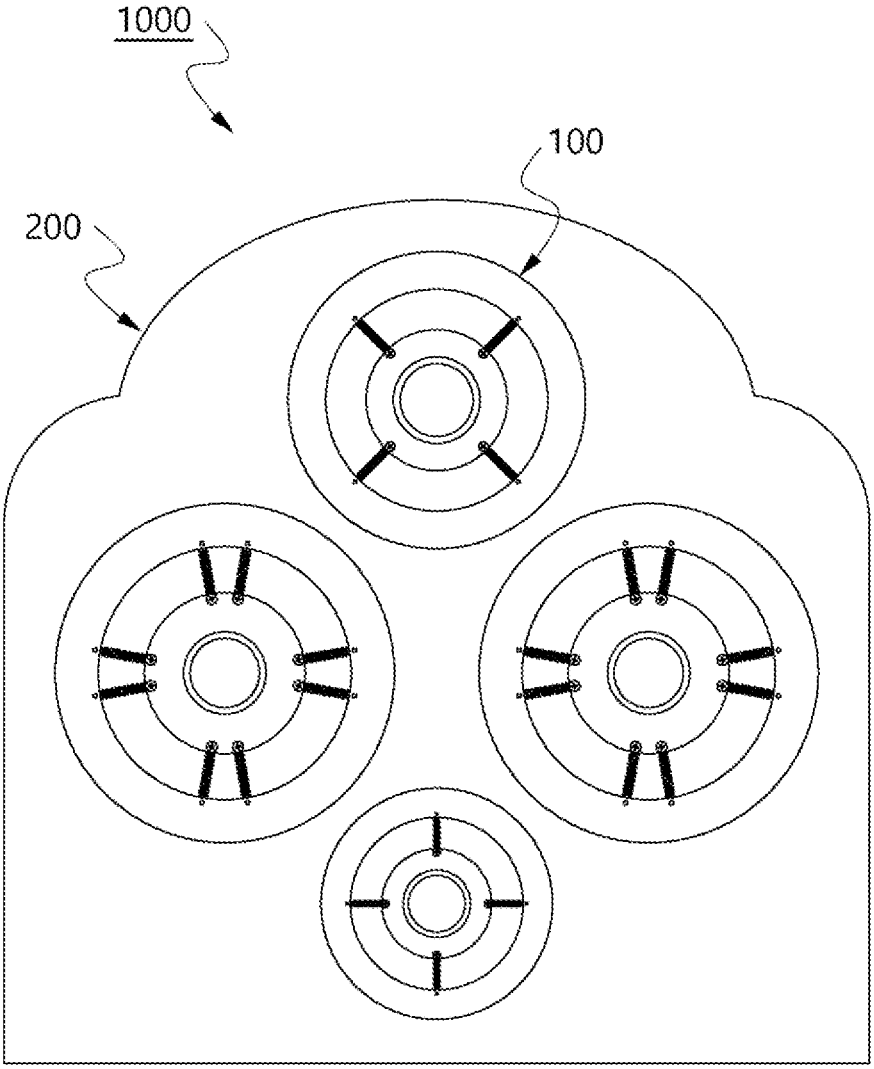
FIG. 3 is a schematic perspective view of a vibration device according to the present invention.

FIG. 1 is an exploded perspective view of a vibration module included in a vibration device according to the present invention. FIG. 2 is a schematic side view illustrating a configuration of a vibration module included in a vibration device according to the present invention. FIG. 3 is a schematic perspective view of a vibration device according to the present invention.

As illustrated in FIGS. 1 to 3, a vibration device 1000 according to the present invention may include at least one vibration module 100 for generating vibration and transferring vibration to a user, a cushion 200 on which the at least one vibration module 100 is mounted, a controller (not shown) for receiving a vibration signal for sound wirelessly or via wire and transmitting a driving signal to the at least one vibration module 100, a power supply (not shown) for supplying power to the at least one vibration module 100 and the controller, and the like.

The vibration module 100 may be mounted on the cushion 200 such that an upper surface thereof is exposed to the outside. Specifically, the vibration module 100 may include a fixing part 110 fixed on the cushion 200, a vibration transmission part 120 connected to the fixing part 110 to be in contact with the user's body so as to transmit vibration to a user, and a vibration part 130 for generating vibration and apply the vibration to the vibration transmission part 120.

A shape of the fixing part 110 is not particularly limited, and may have, for example, a ring shape with an inner empty space in which the vibration transmission part 120 may be disposed, and preferably, a circular ring shape, and may be formed of a lightweight plastic material having enough strength to be applicable to the vibration device 1000.

The vibration transmission part 120 may include a vibration plate 121 to which the vibration part 130 is connected, at least one protruding pin 122 disposed on an upper surface of the vibration plate 121, an elastic member 123 for connecting the vibration plate 121 and the fixing part 110, and the like.

Here, the vibration plate 121 may be formed of the same material as the fixing part 110, disposed in the inner empty space of the fixing part 110, and have a shape, e.g., a circular shape, corresponding to a shape of the inner empty space of the fixing part 110, and the total distance between the vibration plate 121 and an inner wall of the fixing part 110 may be about 1 to 100 mm.

When the total distance between the vibration plate 121 and the inner wall of the fixing part 110 is less than about 1 mm, interference may occur between the vibration plate 121 and the fixing part 110 when the vibration plate 121 vibrates and thus vibration is not likely to be transmitted or the fixing part 110 or the vibration transmission part 120 is likely to be damaged. When the total distance between the vibration plate 121 and the inner wall of the fixing part 110 is greater than 100 mm, a magnitude of secondary vibration transmitted from the vibration plate 121 to the fixing part 110 is weak and thus an effect of vibration transmitted to a user may reduce.

The protruding pin 122 is a part in contact with the user's body, and may intensively transmit, to the user, vibration generated by the vibration part 130 and transmitted to the vibration plate 121. To this end, the protruding pin 122 may be designed to have a cross-sectional area which is 15 to 40% of an area of the upper surface of the vibration plate 121, and have a height such that an upper surface thereof is flush with the upper surface of the fixing part 119 with respect to a side surface of the vibration module 100 as illustrated in FIG. 2.

To transmit soft vibration feeling to a user, the protruding pin 122 may be formed of rubber, e.g., at least one rubber selected from the group consisting of styrene butadiene rubber, poly chloroprene rubber, nitrile-butadiene rubber, isoprene-isobutylene rubber, butadiene rubber, isoprene rubber, ethylene propylene rubber, polysulfide rubber, silicone rubber, fluoro rubber, urethane rubber, and acrylic rubber.

Therefore, when a user of the vibration device 1000 brings his or her body into contact with the vibration device 1000, the fixing part 110 and the protruding pin 122 of the vibration module 100 simultaneously come into contact with the user's body and thus the user may simultaneously experience primary vibration due to contact with the protruding pin 122 and secondary vibration due to contact with the fixing part 110.

The elastic member 123 is a means for connecting the fixing part 110 and the vibration plate 121 to each other, may include, for example, a spring, and may be arranged at regular intervals in a space between the fixing part 110 and the vibration plate 121.

In addition, the elastic member 123 may have enough elasticity to contract or expand due to an external force, so that the vibration plate 121 may hang down in the direction of gravity due to the weight of the vibration part 130 connected to a lower portion of the vibration plate 121. In this case, as described above, the elastic member 123 may have enough elasticity to make the upper surface of the fixing part 110 and the upper surface of the protruding pin 122 be flush with each other.

The vibration part 130 may include a motor having a motor body 131 and a rotating rod 132, e.g., an AC motor, a DC motor, a geared motor, a stepping motor, a servo motor, a brush motor, a brushless motor, a reversible motor, a shade-type motor, a synchronous motor, or a universal motor, and preferably, a brushless motor; an eccentric weight 133 connected to the rotating rod 132; a coupling member 134, such as a bracket, for fixing the motor body 131 on the lower surface of the vibration plate 121; and the like.

Here, a shape of the eccentric weight 133 connected to the rotating rod 132 is not particularly limited, provided the rotating rod 132 is connectable to a portion of the eccentric weight 133 that is biased to a side from the center of gravity of the eccentric weight 133, and a shape of the member 134 is not particularly limited, provided the motor body 131 is fixable to the lower surface of the vibration plate 121 by bolts and nuts.

Through the above-described structure, in the vibration module 100 according to the present invention, the rotating rod 132 is rotated about the motor body 131 of the vibrating unit 130 and thus the eccentric weight 133 connected to an end of the rotating rod 132 is rotated, thus causing the motor body 131 to vibrate up and down. The vibration of the motor body 131 is transmitted to the vibration plate 121 and thus the protruding pin 122 on the upper surface of the vibration plate 121 vibrates up and down, thereby transmitting primary vibration to a user's body in contact with the protruding pin 122 and transmitting secondary vibration generated from the primary vibration to the user's body through the fixing part 110 connected to the vibration plate 121 via the elastic member 123. Therefore, the user may experience weak vibration due to the secondary vibration in a wide range while experiencing strong vibration due to the primary vibration in a narrow range, thereby causing the user to feel vibration more effectively.

The cushion 200 may not only support a user's body but also protect the vibration module 100 mounted therein from the outside, and may be formed of, for example, at least one material selected from the group consisting of memory foam, urethane foam, polyethylene foam, magic foam and latex, and preferably, a cool sheet including a Hisobead material, a jelly sheet, a ventilation sheet or a mesh type sheet to provide a comfortable environment to the user. An outer surface of the cushion 200 may be covered with a separate outer jacket.

The controller receives a vibration control signal generated by an application 4000 for a portable terminal of a sound vibration system described later via wire or wirelessly, amplifies the vibration control signal to produce a driving signal for driving the motor body 131 of the vibration part 130 of the at least one vibration module 100, and drives each of the at least one vibration module 100 by the drive signal.

The power supply may be connected to a motor of each of the at least one vibration module 100 via a separate cable to supply power to the controller, and include a storage battery, a power cable, or the like.

Figure 4:
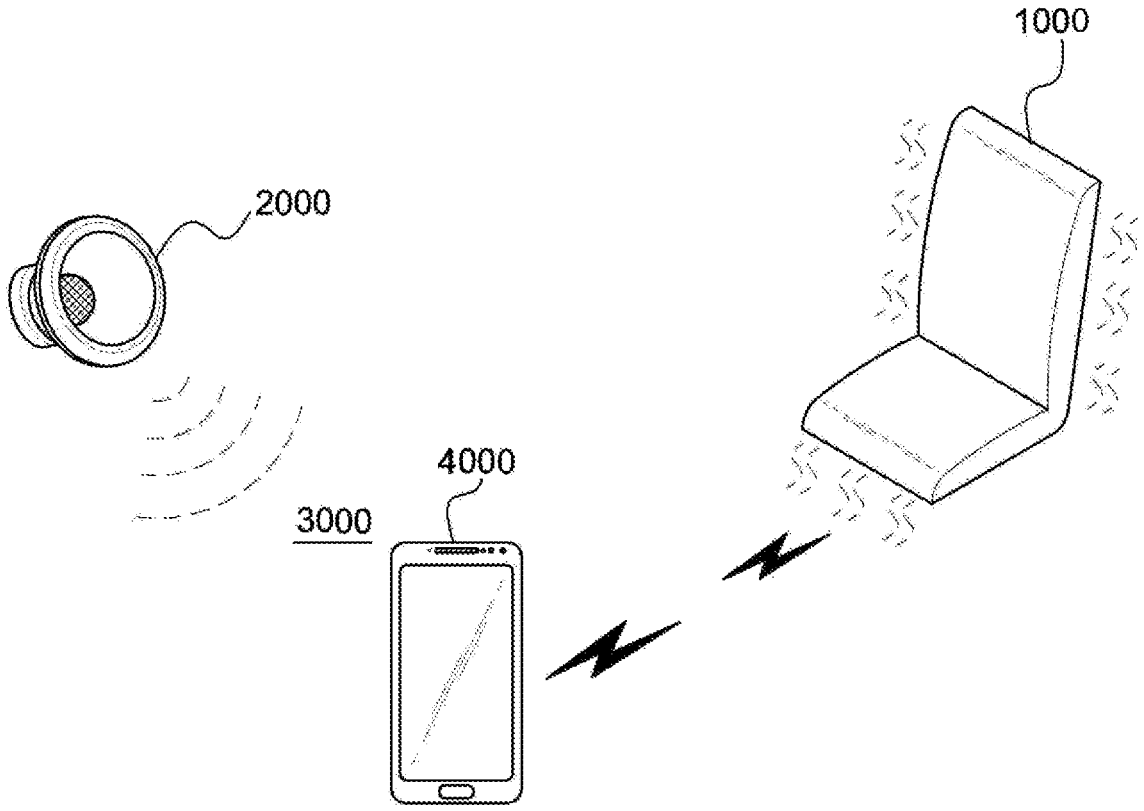
FIG. 4 is a schematic diagram of a vibration system using sound according to the present invention.

FIG. 4 is a schematic diagram of a vibration system using sound according to the present invention.

As illustrated in FIG. 4, a vibration system using sound according to the present invention may include an application 4000, for a portable terminal, which is installed in a portable terminal 3000 to receive via the portable terminal 3000 a digital sound signal provided from a sound source 2000 outside the system or obtained by converting an analog sound signal from the external sound source or to process a digital sound signal from a sound source file stored in an internal storage of the portable terminal 3000, a vibration device 1000 for receiving a control signal generated according to a sound signal processed by the application 4000 for a portable terminal and generating vibration according to the control signal, and the like.

The sound source 2000 is not particularly limited as long as it provides an analog or digital sound signal, and may generally include a sound device equipped with a speaker, a TV, a monitor, a sound source streaming server, and the like.

The portable terminal 3000 is not particularly limited as long as it includes an input unit for receiving a sound signal or a storage storing a sound source file, a processor having installed therein an application for generating a control signal by processing an input or stored sound signal, a transmitter for transmitting the generated control signal via wire or wirelessly, and the like, and may include, for example, a smart phone, a table PC, etc. The portable terminal 3000 may generate a control signal by processing a sound source file stored in the internal storage without receiving a sound signal from the outside.

Figure 5:
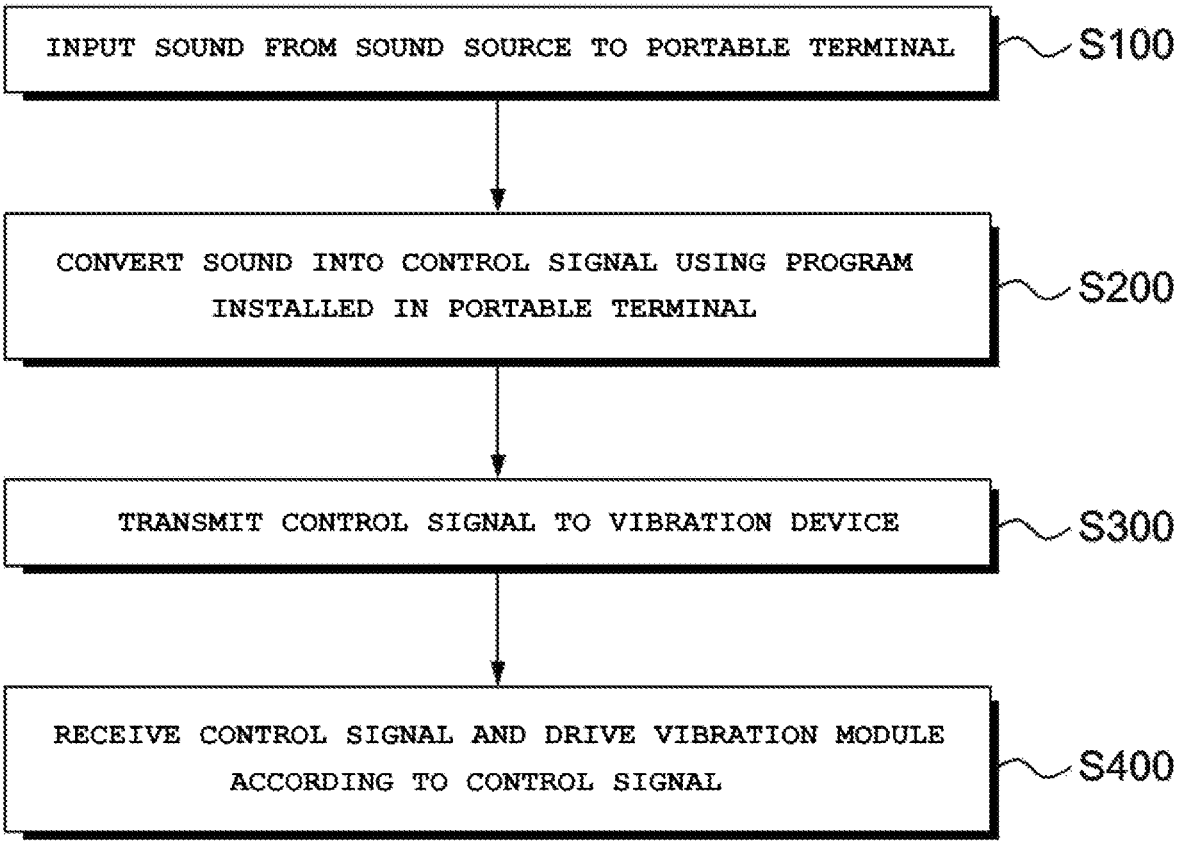
FIG. 5 is a flowchart sequentially illustrating a driving method of a vibration system using sound according to the present invention.

FIG. 5 is a flowchart sequentially illustrating a driving method of a vibration system using sound according to the present invention.

As illustrated in FIG. 5, a vibration system using sound according to the present invention may be driven by a method including operations described below, and the operations may be performed simultaneously or sequentially.

An analog or digital sound signal from an external sound source 2000 is input to a portable terminal 3000 (S100).

The sound signal is converted into a control signal using the program 4000 installed in the portable terminal 3000 (S200).

The control signal obtained by the conversion by the program 4000 installed in the portable terminal 3000 is transmitted to the vibration device 1000 (S300).

The vibration device 1000 receives the control signal from the portable terminal 3000 and drives the vibration module 100 according to the control signal (S400).

Specifically, the portable terminal 3000 may receive the sound signal, for example, through a microphone in operation S100, the program 4000 installed in the portable terminal 3000 may be, for example, a downloaded and installed mobile application in operation S200, the control signal may be transmitted through wireless communication such as Bluetooth or Wi-Fi or through wired communication via a USB cable or the like in operation S300, and the vibration module 100 may include, for example, a BLDC vibration motor in operation S400.

Figure 6:
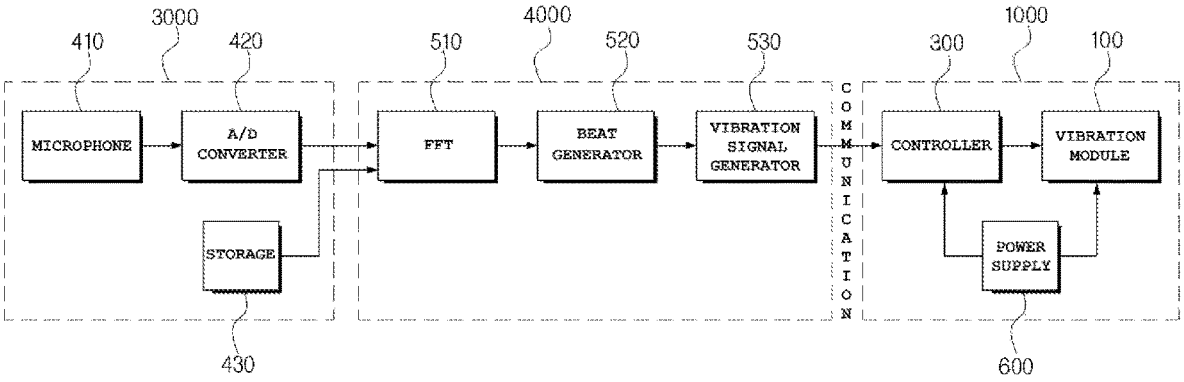
FIG. 6 is a schematic block diagram of a detailed configuration of a vibration system using sound according to the present invention.

FIG. 6 is a schematic block diagram of a detailed configuration of a vibration system using sound according to the present invention.

As illustrated in FIG. 6, a portable terminal 3000 receives a digital sound signal received from the sound source 2000 via a microphone 410 or a digital sound signal obtained by converting a supplied analog sound signal by an analog-to-digital (A/D) converter 420, or processes a digital sound signal from a sound source file stored in an internal storage of the portable terminal 3000 by the application 4000, for a portable terminal, which is a program stored in the portable terminal 3000.

Specifically, in the application 4000 for a portable terminal, an input digital sound signal is divided into N frequency band signals by performing a Fast Fourier Transform (FFT) by an FFT unit 510, a sound signal of a specific frequency band is selected from among the N frequency band signals and a beat is generated from the selected sound signal by a beat generator 520, and a vibration control signal is generated according to the beat generated by the beat generator 520 and transmitted to a vibration device 1000 by a vibration signal generator 530.

Here, the FFT is a means for dividing an input digital sound signal into N digital signals according to frequency bands through a mathematical operation, whereby the input digital sound signal may be accurately divided into sound signals according to frequency bands without losing or adding a sound signal, unlike a method of dividing an analog sound signal according to frequency bands by an analog frequency filter according to the related art.

Figure 7:
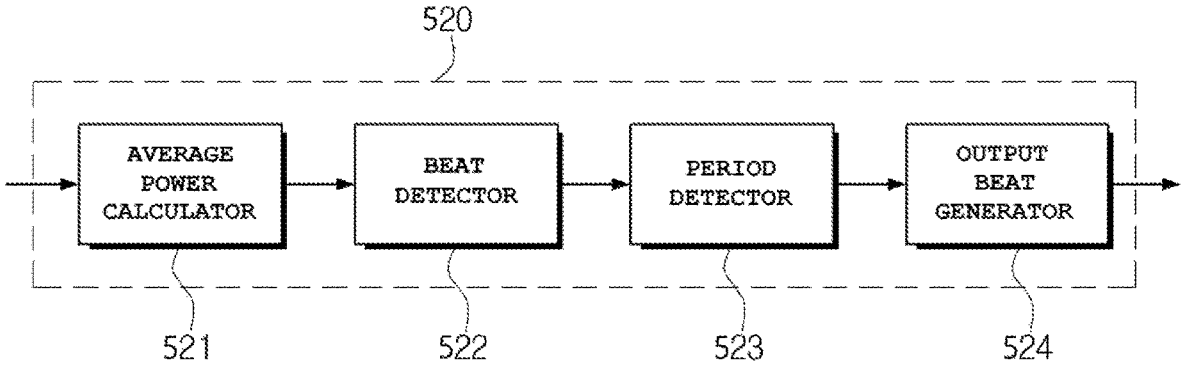
FIG. 7 is a schematic block diagram of a detailed configuration of a beat generator of FIG. 6.

FIG. 7 is a schematic block diagram of a detailed configuration of a beat generator of FIG. 6.

As illustrated in FIG. 7, in the application 4000 for a portable terminal, the beat generator 520 may include an average power calculator 521, a beat detector 522, a period detector 523, an output beat generator 524, and the like.

Specifically, the average power calculator 521 continuously calculates, in real time, moving average power of N digital sound signals according to frequency bands output from the FFT unit 510, and particularly, moving average power of a digital sound signal of a low-frequency band. Here, the moving average power of the sound signal does not simply refer to the intensity (volume) of the signal at a specific moment but refers to an average value of the intensity (volume) of the signal at the specific moment and the intensity (volume) of the signal for a certain time period prior to the specific moment, i.e., a factor representing a trend in an overall intensity (volume) of the signal.

The beat detector 522 receives the moving average power of the digital sound signals according to frequency bands from the average power calculator 521, and selects a sound signal of a specific frequency band most suitable for detecting a beat, e.g., a sound signal having a large change in overall intensity (volume). Generally, a beat refers to sound of a low frequency band, such as a drumbeat, and thus one of low-frequency band signals is selected. The selected sound signal of the specific frequency band is observed in real time and a point thereof having a peak value is detected as a beat.

Here, in order to prevent detection of false beat, the peak value of the selected sound signal of the specific frequency band may be limited to a time point corresponding to a multiple or more of the intensity of the moving average power, e.g., a time point corresponding to twice or more of the intensity of the moving average power.

The period detector 523 statistically analyzes beats consecutively detected by the beat detector 522 to find bars of the score of the selected sound signal. The finding of the bars of the score refers to finding time intervals (periods) at which the bars of the score that runs along a time axis are played and a start time of each of the bars of the score. Vibrations of various rhythms matching the beats may be freely added when the bars of the score played in real time are found.

Next, the output beat generator 524 generates output beats of various rhythms matching the real beat of the sound according to user settings, based on the beats detected by the beat detector 522 and each bar of the score of the selected sound signal detected by the period detector 523, i.e., the time intervals (periods) at which the bars are played and the start time of each of the bars.

Therefore, the vibration signal generator 530 generates a vibration control signal for driving the motor body 131 of the vibration part 130 of each of vibration modules 100 of the vibration device 1000 on the basis of the output beats generated by the output beat generator 524, and transmits the vibration control signal to the controller 300 of the vibration device 1000 according to communication standards through Bluetooth, Wi-Fi, wired communication or the like. Here, various changes may be made in the rhythm, intensity, length, depth, and the like of the output beats according to user settings.

The vibration control signal may include all vibration control signals for the vibration modules 100 when a plurality of motor bodies 131, such as vibration motors, are included in the vibration part 130 of the vibration device 1000, and pulse width modulation is applicable to the vibration control signal to adjust a degree of rotation of the motor bodies 131 of the vibration modules 100.

The application 4000 for a mobile terminal may provide a menu for a user to select a magnitude and method of vibration. For example, the magnitude of vibration may be automatically adjusted according to the volume of sound or arbitrarily adjusted by a user. In addition, one of predetermined rhythms may be selected so that a user may output vibration of a desired rhythm according to a beat.

Then, the vibration modules 100 may be driven in the same manner or different manners. For example, vibration corresponding to a fast beat may be implemented by the vibration module 100 in a backrest of the vibration device 1000 and vibration corresponding to a slow beat may be implemented by the vibration module 100 in a seat of the vibration device 1000. The vibration module in the backrest of the vibration device 1000 and the vibration module 100 in the seat of the vibration device 1000 may be alternatively implemented in the same manner and the different manners according to a certain time pattern. Accordingly, the beat of sound may be felt in various ways through the vibration device 1000 and the vibration system comprising the same according to the present invention.

The vibration device 1000 using sound according to the present invention does not need a transducer provided in an existing sound vibration device and is capable of generating vibration by the vibration modules such as motors, thereby minimizing the weight and volume thereof, and thus is easy to carry or transfer and is inexpensive to manufacture.

While the present invention has been described above with respect to exemplary embodiments thereof, it would be understood by those of ordinary skilled in the art that various changes and modifications may be made without departing from the technical conception and scope of the present invention defined in the following claims. Thus, it is clear that all modifications are included in the technical scope of the present invention as long as they include the components as claimed in the claims of the present invention.

The invention claimed is:

1. A vibration system using sound, comprising:

an application installed in a portable terminal; and a vibration device comprising at least one vibration module configured to generate vibration according to a vibration control signal from the application, wherein the at least one vibration module comprises:

a fixing part mounted and fixed on a cushion;

a vibration transmission part connected to the fixing part to be in contact with a user's body so as to transmit vibration to a user; and a vibration part configured to generate vibration and apply the generated vibration to the vibration transmission part, wherein the vibration transmission part is disposed in an inner empty space of the fixing part, and the fixing part and the vibration transmission part are connected to each other via at least one elastic member, wherein the vibration transmission part comprises:

a vibration plate to which the vibration part is connected; and at least one protruding element on an upper surface of the vibration plate, wherein a distance between an inner wall of the fixing part and the vibration plate is 1 to 100 mm such that a secondary vibration, which is generated from a primary vibration generated from the vibration part and transmitted to the vibration plate, is transmitted from the vibration plate to the fixing part, wherein the application comprises:

a Fast Fourier Transform (FFT) unit configured to perform FFT to divide a digital sound signal converted from an analog sound signal received via a microphone of the portable terminal, a digital sound signal streamed over the Internet, or a digital sound signal from a sound source file stored in an internal storage of the portable terminal into digital sound signals according to N frequency bands;

a beat generator configured to select a sound signal of a specific frequency band from among the N frequency-band digital sound signals and generate a beat from the selected sound signal; and a vibration signal generator configured to generate a vibration control signal according to the beat generated by the beat generator, wherein the beat generator comprises:

an average power calculator configured to calculate in real time an average power level of the N frequency-band digital sound signals output from the FFT unit; and a beat detector configured to receive information regarding a moving average power level of the N frequency-band digital sound signals from the average power calculator, select a sound signal of a specific frequency band most appropriate for detection of beats, and identify as a beat a point at which a strength of the selected sound signal has a peak value.

2. The vibration system of claim 1, wherein the fixing part has a circular ring shape, and the vibration plate has a circular shape corresponding to a shape of the inner empty space of the fixing part.

3. The vibration system of claim 1, wherein a plurality of elastic members are arranged at regular intervals in a space between the fixing part and the vibration plate.

4. The vibration system of claim 1, wherein a cross-sectional area of the protruding element is 15 to 40% of an area of the upper surface of the vibration plate.

5. The vibration system of claim 1, wherein the vibration part comprises:

a motor including a main body and a rotating rod;

an eccentric weight connected to the rotating rod; and a coupling member for fixing the main body onto the vibration transmitting part.

6. The vibration system of claim 1, wherein the vibration device further comprises:

a controller configured to transmit a driving signal to the at least one vibration module; and a power supply configured to supply power to the at least one vibration module and the controller.

7. The vibration system of claim 1, wherein the average power calculator calculates the moving average power level of the N frequency-band digital sound signals output from the FFT unit in real time.

8. The vibration system of 7, wherein the sound signal of the frequency band most appropriate for detection of beats comprises a low-frequency band signal with a highest degree of a change of the moving average power level.

9. The vibration system of claim 7, wherein the beat detector identifies as a beat a point at which the selected signal of the specific frequency band has a peak value greater than or equal to a certain multiple of the moving average power level.

10. The vibration system of claim 1, wherein the beat generator further comprises:

a period detector configured to statistically analyze beats detected by the beat detector to identify bars of a score of a sound signal; and an output beat generator configured to generate an output beat matching the beat from the beat detected by the beat detector and the bars of the score of the selected sound signal identified by the period detector.

11. The vibration system of claim 10, wherein the bars of the score of the selected sound signal comprises a time interval and starting time of each of each of the bars of the score played along a time axis.

* * * * *